United States Patent [19]

Modafferi

[11] 4,403,112

[45] Sep. 6, 1983

[54] PHASE SHIFT LOW FREQUENCY LOUDSPEAKER SYSTEM

[75] Inventor: Richard Modafferi, Vestal, N.Y.

[73] Assignee: Modafferi Acoustical Systems, Ltd., Baldwin, N.Y.

[21] Appl. No.: 265,045

[22] Filed: May 18, 1981

[51] Int. Cl.[3] ..... H04R 1/28

[52] U.S. Cl. ..... 179/1 E; 179/1 GP; 179/115.5 PS

[58] Field of Search ..... 179/1 E, 115 PS, 1 A, 179/1 GA, 1 GP, 1 G

[56] References Cited

U.S. PATENT DOCUMENTS 3,725,586 4/1973 Iida ..... 179/1 G
3,984,635 10/1976 Nestorovic et al. ..... 179/1 E

FOREIGN PATENT DOCUMENTS 53-116102 10/1978 Japan ..... 179/1 GP
54-58404 5/1979 Japan ..... 179/1 GP
1456790 11/1976 United Kingdom ..... 179/115.5 PS

*Primary Examiner*—G. Z. Rubinson
*Assistant Examiner*—Robert Lev
*Attorney, Agent, or Firm*—Arthur H. Swanson

[57] ABSTRACT

An audio speaker system is disclosed providing improved fidelity of performance from overdamped woofer drivers in small sealed enclosures. At least two woofer drivers are employed, and are driven electrically in such a manner that the phase difference in the electrical signals to the two drivers, or sets of drivers if more than two are employed, will be near zero at the lowest bass frequency and will increase to a value up to 180 degrees at the highest bass frequency which is generally taken as the woofer-midrange crossover frequency. This aforementioned phase difference in the electrical signal inputs to two sets of woofers common to one sealed enclosure improves over prior art by providing increased low-bass acoustic output, less acoustic wave interference between the woofers and the midrange drivers, and a smoother input impedance characteristic in the bass frequency region.

28 Claims, 26 Drawing Figures

P-Z OF $V_2$

FREQUENCY RESPONSE $U_1 = U_2$
$F_1 = F_2$ $U_1 = U_2$
$F_1 = F_2$ $U_1 = U_2$
$F_1 = F_2$
$\frac{1}{C_{BOX}} = \frac{1}{C_{a_1}} - \frac{1}{C_{a_2}}$

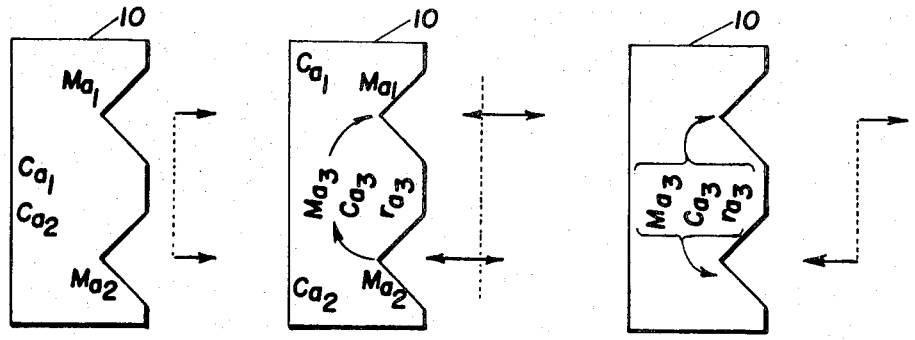
Fig. 7(a) IN PHASE
Fig. 7(b) INTERMEDIATE PHASE
Fig. 7(c) OUT OF PHASE (180°)
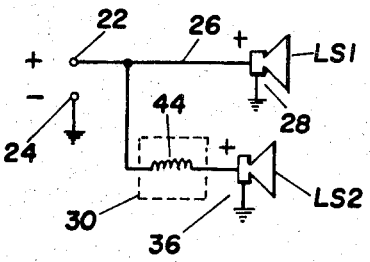
Fig. 8(a)
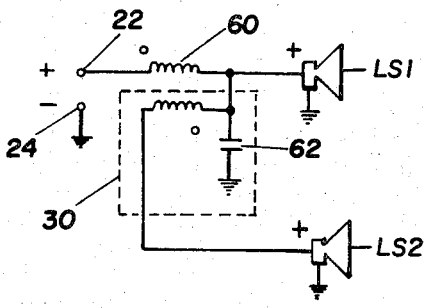
Fig. 8(d)
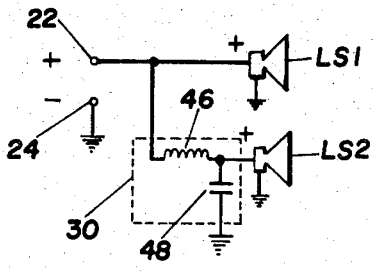
Fig. 8(b)
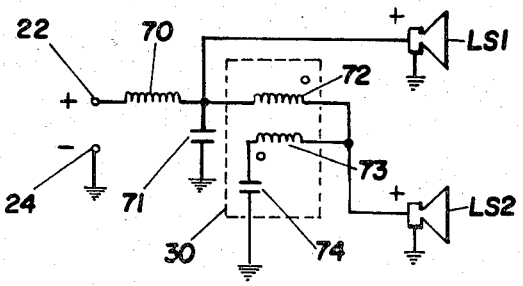
Fig. 8(e)
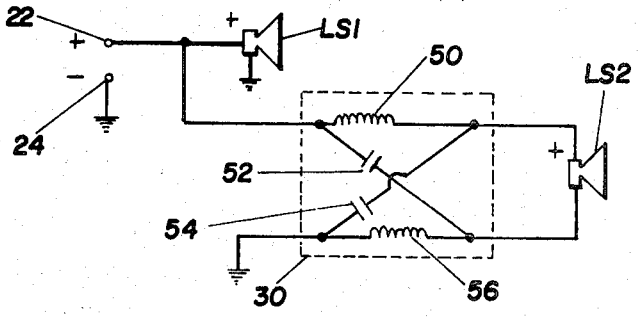
Fig. 8(c)

PHASE SHIFT LOW FREQUENCY LOUDSPEAKER SYSTEM

BACKGROUND OF THE INVENTION

1. Field of the Invention

This invention relates to sound translating devices and more particularly to a method of and means for enhancing the fidelity of reproduction, in the bass acoustic range, of audio loudspeaker systems of the "acoustic suspension" type.

2. Description of the Prior Art

Audio loudspeaker systems that operate on acoustic suspension or bass-reflex principles generally employ a single electrically driven bass driver. This has required for the production of adequate low frequency sound output a "woofer", or bass driver diaphragm of relatively large size compared to the size of the enclosure, that is, cabinet or box, in which the diaphragm is housed.

One of the problems inherent in any loudspeaker system using relatively large woofer diaphragms in relatively small boxes is that the low frequency response of the system is impaired. In order to obtain response to lower frequencies, the total woofer diaphragm area has to be made smaller or the box larger, or both. Small woofer diaphragms are undesirable, however, because the available sound power output is reduced. Big boxes are undesirable because of their large physical size.

An audio loudspeaker system that operates on a so-called "active bass-reflex" principle is disclosed in U.S. Pat. No. 3,984,635 granted on Oct. 5, 1976 to the present inventor and Mioljub R. Nestorovic as copatentees, which patent hereinafter is referred to as the "Nestorovic" patent. This system bears a superficial similarity to that of the present invention, but as explained herein, operates on entirely different principles.

In the system of the Nestorovic patent, two drivers are employed, one of which is active at all frequencies of the low frequency range, and the other of which operates both electrically and acoustically in parallel with the first driver at the upper end of the range but behaves similarly to a passive sound radiator at the lower end of that range. Consequently, at low frequencies, near zero, the woofer diaphragms operate out of phase by substantially 180°. As the frequency is increased, the diaphragms are gradually driven more in phase, the phase difference approaching 0° at the upper frequency limit of the woofers.

While an improvement on loudspeaker systems operating on the "bass-reflex" principle, this system of the Nestorovic patent leaves something to be desired in that there is an undesirable out of phase diaphragm motion at subsonic frequencies and excessive sound output at the upper bass frequencies. Additionally, the system exhibits an uneven impedance characteristic that causes an undesirably varying load to the amplifier driving the speakers.

SUMMARY OF THE INVENTION

An object of the invention is to provide a method of and means for overcoming the problems of the prior art audio loudspeaker systems operating in the bass acoustic range.

Another object of the invention is to provide a method of and means for overcoming the difficulty of prior art low frequency audio loudspeaker systems thereby to allow the use of relatively large woofer diaphragms in relatively small boxes while enhancing the low frequency output.

Still another object of the invention is to provide an improved audio loudspeaker system that is operative in the bass acoustic range and in which the total sound output of the woofers at the lower frequency end of the range is enhanced.

A further object of the invention is to provide such an improved audio loudspeaker system in which the total sound output of the woofers at the higher frequency end of the bass acoustic range is reduced, while also reducing acoustic wave interference between the woofers and the midrange driver(s).

In accomplishing these and other objectives of the present invention there is provided an improved audio loudspeaker system that is operative in and provides enhanced fidelity of reproduction in the bass acoustic range. In one preferred embodiment of this system, two woofers or bass drivers are used, one of which is connected directly to the electrical signal to be reproduced, with the other connected to the electrical signal to be reproduced after passing the signal through a special reactive network. This reactive network causes a phase shift in the electrical drive signal such that—taken as a vector sum—greater total diaphragm excursion occurs at the lower bass frequencies, and less total diaphragm excursion occurs at the higher bass frequencies. The two bass drivers are acoustically coupled in the same cabinet or box which may be sealed such that the system operates in a manner that is similar to the acoustic suspension principle.

The greater diaphragm excursions of the bass drivers at the lowest bass frequencies produce enhanced low frequency output. The reduction in diaphragm excursion at the higher frequencies, near the woofer-midrange crossover frequency, is advantageous, as will become apparent as the description of the invention proceeds, in multi-driver loudspeaker systems in which the invention is embodied.

More specifically, the invention is concerned with a loudspeaker, or audio speaker, system which avoids the sound fidelity shortcomings in the bass acoustic range, especially in low frequency response, in a loudspeaker system operating purely on the acoustic suspension or bass-reflex principles, or the active bass-reflex principle of the Nestorovic patent.

The system of the present invention accomplishes enhanced low-frequency sound output by replacing the driven single bass driver of the acoustic suspension system with two separate electrically driven bass drivers with total diaphragm area equal to the diaphragm area of the replaced single driver. The two bass drivers are so connected for electrical energization that the relative phase shift in the respective drive signal signals to each of the two bass drivers increases with increase in frequency, beginning with zero phase shift at the very low frequencies (D.C.) and increasing to a limit of 180° at frequencies just above the upper cutoff frequency of the drivers (crossover frequency).

With this arrangement the problems of the prior art loudspeaker systems using relatively large woofer diaphragms in relatively small boxes are overcome. The use of relatively large woofer diaphragms in relatively small boxes is allowed, while at the same time enhancing the low frequency output.

In the application of the invention, the two bass drivers are caused to operate in phase at the lowest frequencies, close to D.C., and the phase difference in the two drive signals to the respective bass drivers, or woofers, is allowed to approach 90° in typical multi-driver loudspeaker systems, or 180° in the usual "satellite" subwoofer system, these upper-frequency phase shifts being at the upper frequency limit of the bass drivers, this limit being generally taken as the woofer-midrange crossover frequency.

The operating principle of the present invention is entirely different from that of the Nestorovic patent. Thus, the system of the Nestorovic patent places the bass drivers acoustically out of phase by 180° at low frequencies, near zero. The system of the present invention, on the other hand, operates the bass drivers in phase (0° phase difference) at the same low frequencies. The Nestorovic system electrically drives the bass drivers more in phase as the frequency is increased, the phase difference approaching 0° at the upper frequency limit of the bass drivers.

Contrasted to this, the system of the present invention causes the phase difference in the drive signals to the bass drivers to increase with frequency, to a limit of 90° or 180°, or some intermediate value, depending upon the design parameters used. Thus, the phase shifts in the bass driver signals are seen to be entirely opposite in sense in the system of the present invention as compared to the system of the Nestorovic patent.

BRIEF DESCRIPTION OF THE DRAWINGS

FIGS. 7*a*, 7*b* and 7*c* show effective mobility analogies for the regions of air inside a box such as the box of FIG. 6, for different conditions of relative phase of diaphragm motion for the two woofers;

FIGS. 8*a*, 8*b*, 8*c*, 8*d* and 8*e* are wiring diagrams, each of which illustrates a separate embodiment of the invention;

DESCRIPTION OF THE PREFERRED EMBODIMENTS

Figure 6:
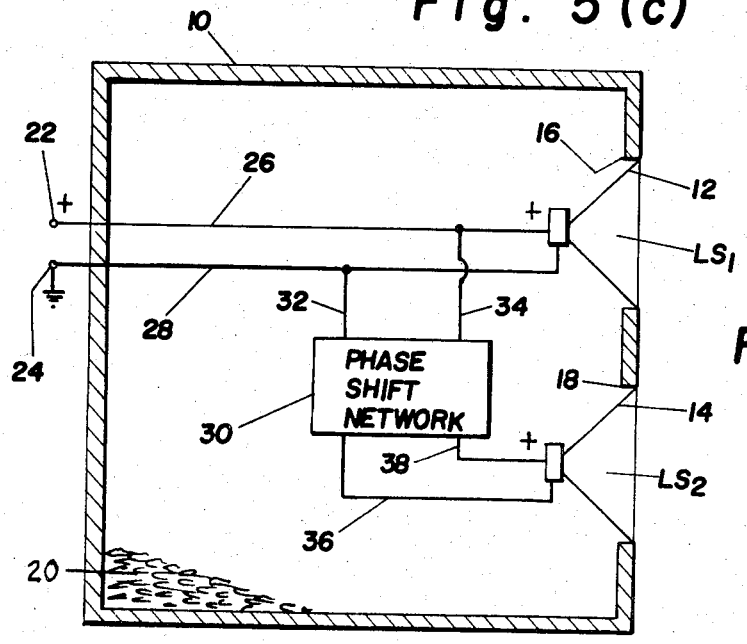
FIG. 6 is a vertical cross-sectional view illustrating the physical layout of the components of an audio loudspeaker system having two woofers and illustrating features of the present invention.

In FIG. 6 there is diagramatically illustrated the physical layout of a loudspeaker system embodying features of the present invention and including a cabinet or box 10 that is shown closed, with the outermost circular free peripheral ends 12 and 14 of a pair of woofers or bass drivers LS1 and LS2, respectively, in registry with diaphragm openings 16 and 18 in the front wall of the box 10. Desirably, the cone mass of LS2 exceeds that of LS1, being of such higher value as the design parameters suitable for the proper functioning of LS2 requires. The self resonance in free air of LS1 is 17 Hertz (Hz) while that for LS2 is 10 Hz, for example, in one embodiment of the invention.

The air volume of the inside of the box is filled substantially entirely with loosely packed sound absorbing material such as fiberglass indicated generally at 20 although any other material suitable for that use may be used.

The air volume within the box 10 directly communicates with the rear of the diaphragms of the LS1 and LS2, thereby providing acoustic coupling between them.

Electrical driving energy for the bass drivers LS1 and LS2 is provided at a pair of electrical terminals 22 and 24 from the output of a suitable amplifier (not shown), terminal 22 being a positive terminal and terminal 24 being connected to ground potential, as shown. Terminals 22 and 24 are connected in energizing relation directly to the terminals of the voice-coil of LS1 by electrical conductors 26 and 28, respectively. The connection of the terminals 22 and 24 to the voice coil of LS2 is through a phase shift network indicated at 30. Specifically, conductors 28 and 26 are connected by electrical conductors 32 and 34, respectively, to the input terminals of the phase shift network 30, the output terminals of the latter being connected in energizing relation to the voice-coil of LS2 by electrical conductors 36 and 38.

The phase shift network 30 per se is further described hereinafter with reference to specific embodiments of the invention, and particularly with reference to the embodiment of the invention illustrated by FIGS. 8*a*, 8*b*, 8*c*, 8*d* and 8*e*.

In order that the present invention may be more readily understood, it is believed that a discussion of both the physical and theoretical considerations involved in its operation and application to loudspeaker systems of the acoustic suspension type should be outlined.

In practical effect, the present invention will be shown to "unload" the box, such as box 10 of FIG. 6, from the bass drivers LS1 and LS2 in the bass frequency range, causing greater diaphragm excursion (taken as a vector sum), and hence, greater sound output. This unloading effect will be explained two ways: (1) Argument from the physical characteristics of the system, and (2) A mathematical "pole-zero" model based upon an analog of the physical system.

(1) Physical Argument

Assuming two bass drivers or woofers placed in a sealed box, as illustrated generally in FIG. 6 for example, and driven electrically in phase (0° phase difference) it can be demonstrated that the air trapped in the sealed box behind the diaphragms will act as a "spring" at low frequencies, decreasing the effective compliance of the diaphragm suspensions and restricting diaphragm movement at low frequencies by raising the system resonant frequency. If, instead the bass drivers are driven 180° out of phase, one diaphragm will be moved in while the other is moved out, thus always being moved in opposite directions. The air inside the box no longer behaves as a spring but behaves as a "mass". The air inside the box oscillates back and forth, following the opposite motion of the bass driver diaphragms. The net result is to cause a significant lowering of the resonant frequency of the system and a very large increase in the diaphragm motion at low bass frequencies. However, the net (vector sum) of the diaphragm motions is ZERO, and hence, the sound output also is zero.

On the other hand, if, as in accordance with the present invention, the phase difference between the bass drivers is made relatively small, 10°, for example, instead of 180° at a specific low bass frequency, the resonant frequency of the box plus the bass drivers, there is a dramatically different result. The air in the box behaves such as to add mass to the system and to reduce its resonant frequency while simultaneously providing greater bass driver diaphragm excursion, and hence, greater sound output. Moreover, the vector sum of the diaphragm excursions now are larger than before when the diaphragms were operated in phase.

The slight out of phase motion (10° in the above example) of the diaphragms of the bass drivers causes the air in the box to behave not simply as a compliance but as an increased compliance plus a mass. The added mass loading and increased compliance upon the bass driver diaphragms cause a significant reduction in the system resonant frequency and an increase in diaphragm motion at low frequencies. Using typical embodiments of the present invention, as described hereinafter, low bass sound power output, at frequencies within the octave centered at the aforementioned system resonant frequency, is increased by approximately 25% to 58%, i.e., equivalent to a sound pressure increase of one decibel (dB) to two dB.

(2) Mathematical Model

The use of a mathematical model (sometimes referred to as a ∓dynamic analogy") to describe a physical system is a very useful and powerful method. By reducing a physical system to a schematic diagram, concepts become clear which by other means would be hopelessly difficult to understand.

Figure 1A:
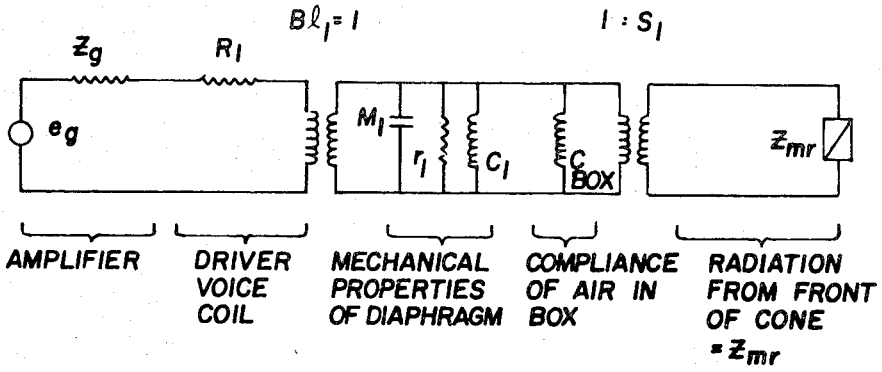
FIG. 1*a* is an equivalent mobility analogy circuit of an analog model of a sealed box acoustic suspension bass speaker system using a single woofer.
Figure 1B:
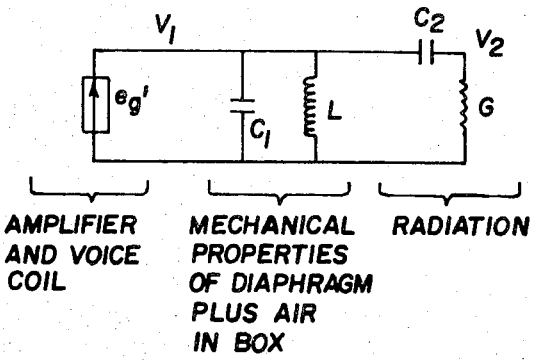
FIG. 1*b* is a simplified equivalent mobility analogy circuit for the model of FIG. 1*a;*
Figure 1C:
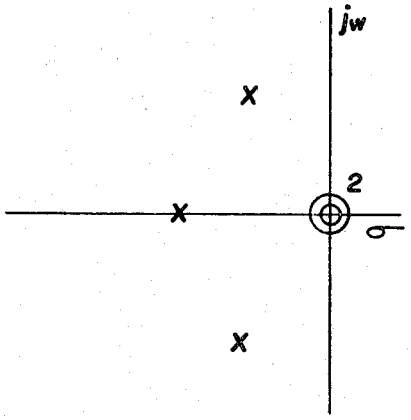
FIG. 1*c* is a pole-zero diagram that is representative of the model of FIG. 1*a;*
Figure 1D:
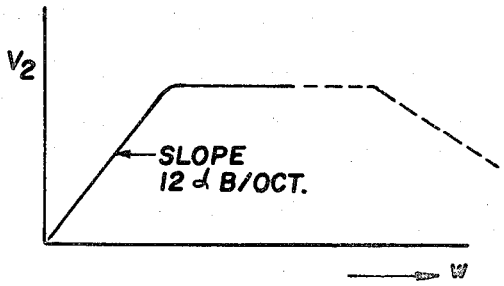
FIG. 1*d* illustrates the output amplitude response curve of the analog model of FIG. 1*a;*

A sealed box acoustic suspension bass speaker system using a single woofer or pair of identical woofers, or bass drivers, may be represented, as illustrated in FIGS. 1*a* or 1*b*, by a simple high-pass filter model (analog) with the p-z as shown in FIG. 1*c*, for which the amplitude response vs. frequency curve is as is illustrated in FIG. 1*d*. This curve is determined by solving the equation for the sound output analog "$V_2$" where $$V_2 \,\alpha \text{ sound pressure} = \frac{eg^1}{C_1} \cdot \frac{S^2}{S^3 + \frac{G(C_1 + C_2)}{C_1C_2} S^2 + \frac{1}{C_1L} S + \frac{G}{C_1C_2L}}$$

In this equation the several symbols are those indicated in the simplified model of FIG. 1*b*. The amplitude response curve of FIG. 1*d* is common and familiar and is adequately treated in publication references in the prior art, for example, in:

1. Leo Beranek "Acoustics", McGraw-Hill, 1954-chapter 8;
2. "Loudspeakers", An anthology of papers published in the Journal of the Audio Engineering Society, October 1978—especially papers by Novak, Small and Thiele; and
3. Martin Colloms "High Performance Loudspeakers", John Wiley and Sons, 1978—page 24.

The phase-shift system of the present invention requires a somewhat more complex model for analysis. A fairly complete model is given in FIG. 2. This model is of the "mechano-acoustic mobility" type. The relationship between the electrical elements of the model and the physical parameters which these electrical elements represent is as follows:

| | | |
|---|---|---|
| | eg | amplifier voltage, volts, |
| | Zg | internal impedance of amplifier, ohms, |
| $L_{e1}$, | $L_{e2}$ | driver voice-coil inductance, henrys, |
| $f_{c1}$, | $f_{c2}$ | force produced by voice coil, newtons, |
| $u_{c1}$, | $u_{c2}$ | velocity of voice coil and attached diaphragm, meters/sec., |
| $U_1$, | $U_2$ | volume velocity behind each diaphragm (inside box) meters$^3$/sec., |
| $C_1$, | $C_2$ | compliance of diaphragm suspension in free air, meters/newton, |
| $M_1$, | $M_2$ | effective diaphragm mass of driver, kilograms, |
| $r_1$, | $r_2$ | mechanical friction losses of diaphragm suspension, MKS mohms, |
| $Z_{mr1}$, | $Z_{mr2}$ | radiation mobility at front of diaphragm, MKS mohms. (note: units of MKS mohms are meters/newton-second), |
| $B_{11}$, | $B_{12}$ | motor strength of driver, webers/meter, |
| $S_1$, | $S_2$ | effective area of diaphragm, meters$^2$, |
| $F_1$, | $F_2$ | acoustic pressure inside box adjacent to rear of driver diaphragm } newtons/meter$^2$, |
| $R_1$, | $R_2$ | driver voice-coil resistance, ohms. |

Figure 2:
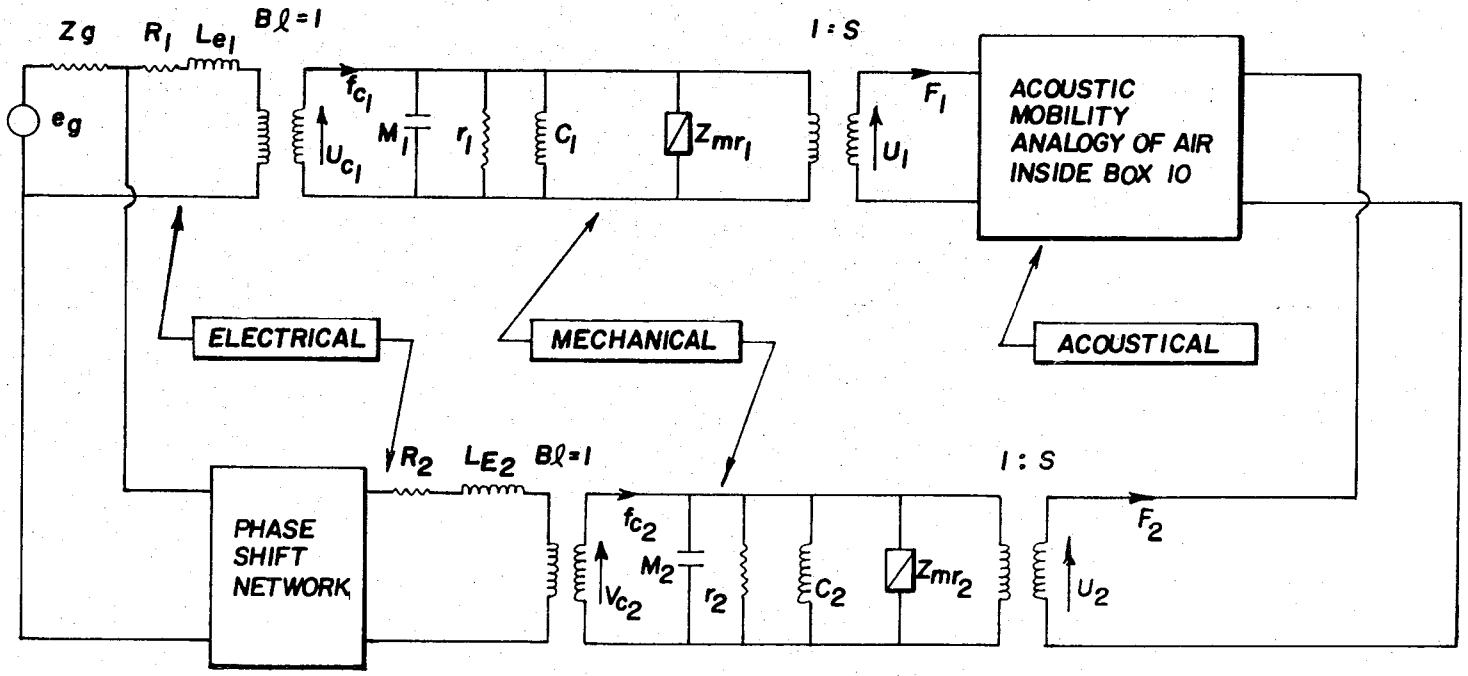
FIG. 2 is an equivalent mobility analogy circuit of an analog model of the phase shift woofer system according to the present invention.

The acoustic output of a bass speaker system represented by the model of FIG. 2 is given by:

$$\text{Acoustic output (total volume velocity) meters}^3\text{/sec.} = Re\left\{ \frac{(S_1)\,(u_{c1})}{Z_{mr1}} + \frac{(S_2)\,(u_{c2})}{Z_{mr2}} \right\}$$

where Re means "real part of" since the quantities in brackets are in general, complex.

A direct solution of the above equation (which is the general system excitation-response function) is extremely difficult. Fortunately, some simplifications can be performed upon the model which will clearly show the behavior of the invention. It is not necessary to explicitly solve any equations since the functions of the model will become apparent upon examination of the circuit parameters of the model. A quotation from the opening paragraph of Ref. (1) is significant here:

"These schematic diagrams made it possible for engineers to visualize the performance of a circuit without laboriously solving its equations . . . such a study would have been hopelessly difficult if only the equations of the system were available."

Figure 3:
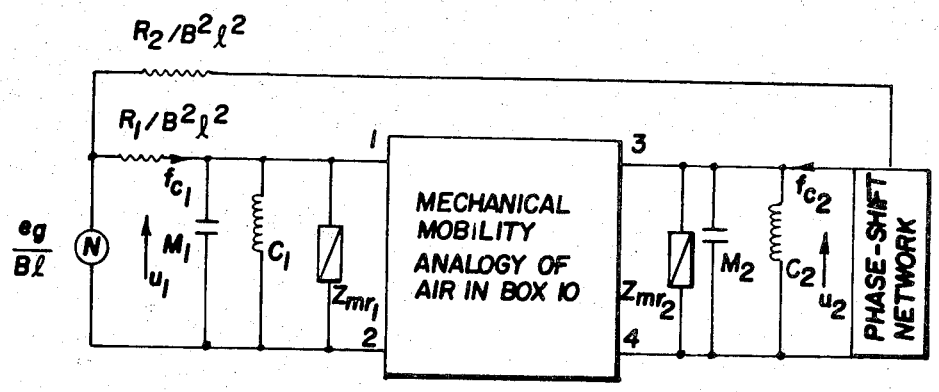
FIG. 3 illustrates a simplified model of the phase-shift woofer system of FIG. 2.

The model of the phase shift system of FIG. 2 can be reduced to the simpler model shown in FIG. 3. The assumptions made in FIG. 3 are as follows:

1. Consideration of low bass frequencies only,
2. Mechanical losses in driver diaphragms are negligible,
3. Driver voice-coil inductances are negligible,
4. Amplifier output impedance is zero.

Since, in the general case of this invention, the separate driver diaphragms vibrate with a phase difference, the air trapped in the box 10 will undergo fairly complicated motions. Some parts of the enclosed air will behave as a "spring" (a compliance) and other parts will behave as a mass. Still other parts of the enclosed volume of air will simultaneously exhibit behavior as a compliance and mass. A model for the air inside the box will now be developed and the effect of this model on the behavior of the system of FIG. 3 examined.

Figure 4A:
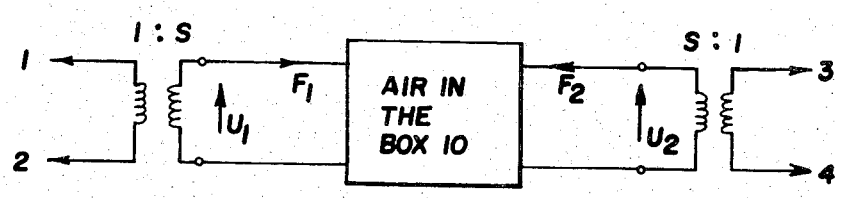
FIGS. 4*a* and 4*b* collectively illustrate an acoustic mobility analogy of air in a box.
Figure 4B:
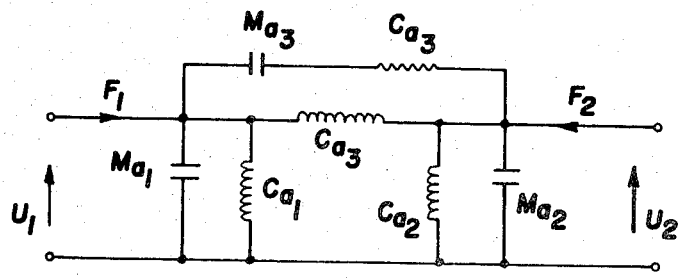

The air inside the box may be described as an acoustic mobility analogy as in FIGS. 4*a* and 4*b* which represent the insides of the "box" shown in FIG. 3.

In FIGS. 2, 3 and 4*a*, $U_1$ and $F_1$ are the respective acoustic volume velocity and sound pressure behind the diaphragm of LS1 (FIG. 6) while $U_2$ and $F_2$ are the same respective parameters for LS2. The interaction of the diaphragms of LS1 and LS2 upon the air inside the box 10 results in the model shown in FIG. 4*b*. Each element of the model in FIG. 4*b* arises as follows:

| | |
|---|---|
| $C_{a1}$ | that portion of the air behind the diaphragm of LS1 acting ans an "air spring" or compliance against the walls of the box. |
| $M_{a1}$ | that portion of the air immediately behind the diaphragm of LS1, which acts as a mass. |
| $C_{a2}$, $M_{a2}$ | same as $C_{a1}$ and $M_{a1}$ but for LS2. |
| $M_{a3}$ | that portion of the air inside the box and between the diaphragms of LS1 and LS2 which acts as a mass between the diaphragms. |
| $C_{a3}$ | that portion of the air inside the box and between the diaphragms of LS1 and LS2 acting as a "spring" or compliance between the diaphragms. |
| $r_{a3}$ | frictional losses resulting from the motion of the air between the diaphragms. |

Before discussing the function of the parameters just given in relation to the model of FIG. 4*b* some properties of acoustical mobility analogies must be stated. A precise acoustic mobility analogy of a volume of air using so-called "lumped" parameters is impossible. This is for the reason that air particles never behave purely as a mass; i.e., all particles moving in unison. Similarly, air never behaves purely as an acoustic compliance because each of the particles making up the "spring" also have mass. Air thus possesses "distributed" parameters, i.e., mass and compliance exist together in various ratios throughout any given volume of air.

The "distributed" parameters of the air inside the box of the instant invention may be represented by a "lumped-parameter" analog model sufficiently accurate to describe the behavior of the invention. Air close to the walls of the box will not exhibit significant motion, but will undergo compressions and rarefactions according to the sound transmitted to it by the rear of the driver diaphragms. Thus air near the boundaries of the box may be treated as an acoustic compliance. This air is represented as $C_{a1}$ and $C_{a2}$ in the model of FIG. 4*b*.

Similarly, the air immediately behind the driver diaphragms can be represented as a mass since it will vibrate almost in unison with the diaphragms. This air is represented by the elements $M_{a1}$ and $M_{a2}$ in the analogy.

Air trapped between two moving surfaces (such as the diaphragms of LS1 and LS2) will behave as both a mass and a compliance, the predominant behavior depending upon the relative motional phase differences of the moving surfaces, the diaphragms of LS1 and LS2.

Figure 5A:
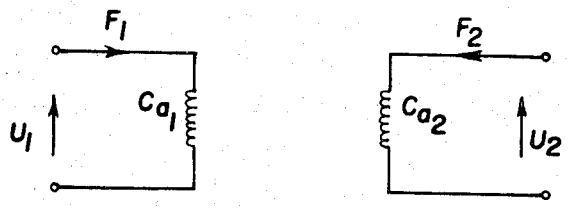
FIGS. 5*a*, 5*b* and 5*c* show the reduction of the analogy of FIG. 4*b* to a single shunt compliance.
Figure 5B:
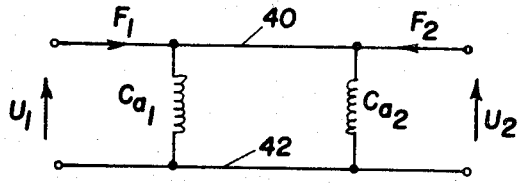
Figure 5C:
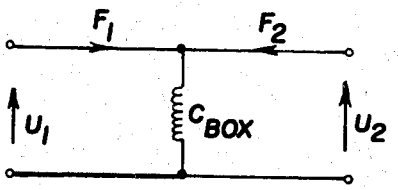

Keeping in mind the concepts just set forth, the mobility model of the air in the box may be studied for different conditions for the electrical drive signals to the voice coils of the LS1 and LS2. First it will be shown that if the LS1 and LS2 are identical and are driven electrically in phase, the model of FIG. 4*b* will reduce to a single shunt compliance as shown in FIG. 5*c* which becomes the analogy of the air inside a simple closed box "acoustic suspension" system.

If the conditions just stated are met, the volume velocities $U_1$ and $U_2$ behind the driver diaphragms will be equal in magnitude and exhibit no phase difference-the diaphragms vibrating in unison. Thus there will be no potential drop across the elements $M_{a3}$, $r_{a3}$, and $C_{a3}$ of FIG. 4*b*, i.e., the acoustic pressures $F_1$ and $F_2$ inside the box adjacent to the rear of the respective diaphragms will be equal to each other and their difference equal to zero. Elements $M_{a3}$, $r_{a3}$, and $C_{a3}$ then have no net effect at all and can be removed. Further simplification is possible by considering the air in the box to behave purely as a compliance, and hence, the masses $M_{a1}$ and $M_{a2}$ of the driver diaphragms may be removed. The result yields the model of FIG. 5*a*. Since there is no potential drop between the two sides of FIG. 5*a*, both sides may be connected to each other by conductors, such as conductors 40 and 42, as shown in FIG. 5*b*, and further combined into the parallel circuit of FIG. 5*c*. The model of FIG. 5*c* is the same as that for the air in the box for a simple acoustic-suspension system, using two drivers driven electrically in parallel.

If the drivers are non-identical but driven electrically in parallel, the system will also reduce to the simple acoustic suspension case. The elements $M_{a3}$, $r_{a3}$, and $C_{a3}$ will disappear or be insignificant throughout the bass frequency range, and thus, for non-identical drivers the system still will behave as a single larger driver in a sealed box.

With identical or non-identical drivers driven electrically using the phase shift network of the present invention, such that an electrical phase difference exists throughout the bass frequency range, the components $M_{a3}$, $r_{a3}$, and $C_{a3}$ remain active in the model of FIG. 4*b* throughout the bass frequency range.

It is noted that forcing the components $M_{a3}$, $r_{a3}$, and $C_{a3}$ to remain active (i.e., that these elements exist) in the model of FIG. 4*b* for all low bass frequencies is basic to the idea of the present invention. Since the phase-shift network of FIG. 2 insures that the voice-coil driving currents (and hence the forces produced by these currents) remain out of phase through the bass frequency range, the existence of these elements is guaranteed.

With the existence of $M_{a3}$, $r_{a3}$, and $C_{a3}$ established, it will now be shown that their presence in the model for the air in the box, FIG. 4*b* results in a change in the parameters of the model of FIG. 3 in such a manner as to enhance the low bass output.

(3) Determination of Bass Resonant Frequency of Loudspeaker System

The resonant frequency will first be calculated for a low bass loudspeaker system in which the bass drivers or woofers are identical and driven electrically in parallel. Upon the assumption that the present invention is not used and that the drivers are connected electrically in parallel, we have the following system parameters:
Volume of box . . . 70 liters=0.07 meter$^3$,
Cone mass of each driver . . . 85 grams=0.085 Kg,
Compliance of each driver . . . $1.03\times10^{-3}$ meters/newton.

The mechanical compliance of the box is computed from equation (2) below:

$$C_{box} = \frac{V}{Poc^2A^2} \quad (2)$$

where
V=volume of box in cubic meters
Po=density of air at 20° C. and sea level
c=velocity of sound at 20° C. at sea level
A=total woofer diaphragm area Solving the above, assuming that each driver has an active diaphragm diameter of 9.5" yields:

$$C_{box}=5.87\times10^{-5} \text{ meters/newton.}$$

It will be noted that the box compliance is much less (by two orders of magnitude) than the driver compliance. This is typical of low bass loudspeaker systems which use relatively large driver diaphragms in relatively small boxes. The expected resonant frequency of a system with the above parameters will now be computed.

The resonant frequency is given by:

$$f_o = \frac{1}{2\pi\sqrt{M_sC_s}} \quad (3)$$

where $C_s$ is the mechanical compliance of the box and $M_s$ is the effective system mass given by the sum of all the moving masses in the system. These masses will be the total diaphragm masses of the drivers plus the mass loading of the adjacent air upon their diaphragms.

The mass loading of air at low frequencies upon a circular diaphragm is given by the approximate relation:

$$M_d=2.67\ a^3Po \quad (4)$$

where a is the diaphragm radius.

Solving the above equation (4) for a diaphragm with a diameter of 9.5" yields:

$$M_d=5.67 \text{ grams}\approx6 \text{ grams.}$$

The total system mass is the diaphragm masses plus the air mass loading on both sides of each diaphragm, or $$M_s=85+85+6\times4=194 \text{ grams or } 0.194 \text{ Kilogram.}$$

Since the box compliance calculated above by solving equation (2) is much less than the driver compliance, the box will "swamp" the driver compliance such that the total system compliance can be considered to be that of the box alone. Thus the system resonant frequency becomes:

$$f_o = \frac{1}{2\pi\,(.194)\,(5.87\times10^{-5})} = 47.2 \text{ Hz.} \quad (3)$$

If the box is stuffed fully but loosely with fiberglass, the action of the air inside the box becomes isothermal instead of adiabatic. This causes the effective volume of the box to increase by the number $\gamma$, the ratio of specific heat of air at constant pressure to that at constant volume. For air, $\gamma$ is given by:

$$\gamma = \frac{c_p}{c_v} = 1.4.$$

Increasing the effective volume of the box by the value 1.4 will also increase the compliance of the box by 1.4 (see equation (2)). This will also decrease the system resonant frequency by the value $\sqrt{1.4}$, (see equation (3)) so that the resonant frequency $f_o^1$ of the box filled loosely with fiberglass equals $(f_o/\sqrt{1.4})$ where $f_o$ is the system resonant frequency with the box empty, specifically 47.2 Hz as calculated above. Thus, $f_o^1=39.8$ Hz.

FIG. 8 depicts five schematic wiring diagrams illustrating various bass loudspeaker systems which when incorporated in a cabinet or box 10 as illustrated and described in connection with FIG. 6, provide useful embodiments of the invention, the operating characteristics of which are further described hereinafter.

FIGS. 8*a*, 8*b* and 8*c* are schematic diagrams of invention embodiments which provide mainly the phase-shift function, separate from any other woofer crossover circuitry, which is external to the terminals 22 and 24 and is not shown. FIGS. 8*d* and 8*e* are schematic diagrams of invention embodiments using mutually-coupled coils wherein the functions of crossover (low-pass filtering) and phase-shifting are combined. The part of the circuitry which can be considered to render mainly a phase-shift function is contained within the dotted box 30.

In the simplest of the embodiments, FIG. 8*a*, it will be noted that the phase shift network 30, indicated in dotted outline, comprises an inductor 44 which is connected in series with LS2. One terminal of inductor 44 is connected to the positive signal terminal 22.

In the embodiment of FIG. 8*b*, the phase shift network comprises an inductor 46 and a capacitor 48. Inductor 46 has one terminal connected to the positive signal terminal 22. Capacitor 48 is connected in parallel or shunt to the voice-coil of LS2.

The phase shift network 30 of the more complex embodiment of the invention illustrated in FIG. 8*c* comprises "an all pass delay network" including first and second pairs of series-connected inductors and capacitors that are connected in parallel to the voice coil of the LS2. Thus an inductor 50 and a capacitor 52 are series-connected in shunt to the voice coil of LS2 with one terminal of the inductor 50 connected to the positive terminal of the voice-coil and the other terminal thereof connected to the positive signal terminal 22. Similarly, a capacitor 54 and an inductor 56 are series-connected in shunt to the voice-coil of LS2 with one terminal of the capacitor 54 connected to the positive terminal of the voice-coil, the terminal of inductor 56 remote from capacitor 54 being connected to ground potential.

Figure 12:
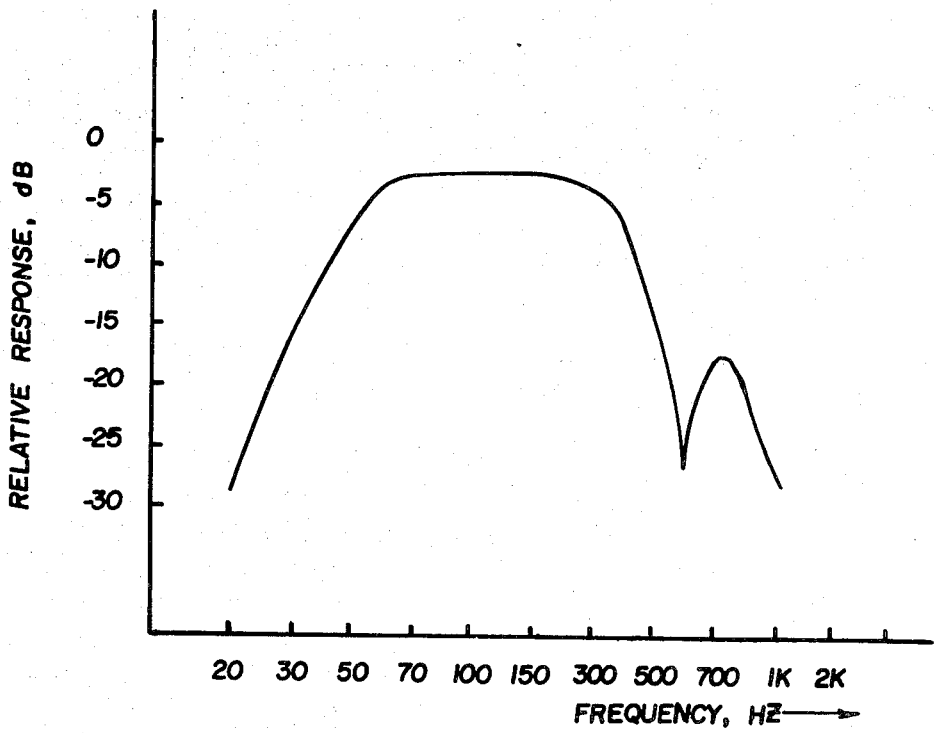
FIG. 12 shows graphically the amplitude vs. frequency response for woofer LS2 of the invention embodiment of FIG. 8*d*.

The phase shift network 30 of the embodiment illustrated in FIG. 8*d* combines the phase-shift function and the low-pass filter crossover function such that both occur simultaneously. A coil 61 which is mutually coupled to the crossover filter coil 60 receives drive signal from one of the input terminals 22. This mutual coupling, in combination with the capacitor 62 and the parameters of LS2 yields the frequency response for LS2 shown in FIG. 12. The deep notch in the response of LS2 is particularly desirable, as it tends to reduce the acoustic wave interference with the midrange driver which would otherwise be contributed by LS2. This embodiment of the invention finds use in those cases where the woofer-midrange crossover frequency is fairly high, which is usually the case in small "bookshelf" speaker systems. In this particular situation, the aforementioned crossover frequency is 500 Hz.

The phase shift network 30 of the embodiment of FIG. 8*e* is a slightly more complex version of the embodiment of FIG. 8*d*. Here, the phase-shift components 72, 73 and 74 are separated more distinctly from the crossover filter elements 70 and 71. The woofer-midrange crossover frequency is 150 Hz.

By way of illustration and not limitation, the component values of the invention embodiments given in FIG. 8 are as follows:

| | | | |
|---|---|---|---|
| Inductor 44 | 5.1 mh | Capacitor 48 | 140 μf |
| Inductor 46 | 5.1 mh | Capacitor 52 | 140 μf |
| Inductor 50 | 6.0 mh | Capacitor 54 | 140 μf |
| Inductor 56 | 6.0 mh | Capacitor 62 | 140 μf |
| Inductor 60 | 3.2 mh | Capacitor 71 | 250 μf |
| Inductor 31 | 3.2 mh | Capacitor 74 | 100 μf |
| Inductor 70 | 6.0 mh | | |
| Inductor 72 | 5.1 mh | | |
| Inductor 73 | 3.2 mh | | |

As is demonstrated hereinafter, upon application of the present invention, the system resonant frequency will be made lower, as will now be calculated, for the two simple embodiments of FIGS. 8*a* and 8*b*. In order to compute the new effective resonance using the invention, the acoustic components $M_{a1}$, $M_{a2}$, $C_{a1}$, $C_{a2}$, $M_{a3}$, $C_{a3}$ and $r_{a3}$, as illustrated in FIG. 4*b*, must be determined.

The elements $M_{a3}$, $C_{a3}$ and $r_{a3}$ of FIG. 4*b* must be considered as a discrete approximation to a distributed mass-compliance element operating between the rear surfaces of drivers LS1 and LS2 are diagrammatically illustrated in FIGS. 7*a*, 7*b* and 7*c*. These elements come into existence because of the phase difference in the motions of the driver diaphragms and are proportional in value to the relative phase difference in their motions. They reach a maximum value when the diaphragm motions are 180° out of phase and cease to exist when the diaphragm motions are exactly in phase. Thus, to a first approximation:

$$M_{a3}=M_{box}\sin(\theta/2) \tag{5}$$

where $M_{box}$ is total mass of air in the box.

$$C_{a3}=C_{box}\sin(\theta/2)$$

where $C_{box}$ is total compliance of air in the box, with respect to both driver diaphragm. $\theta$ is phase difference in diaphragm motions.

$r_{a3}$ depends on frequency and damping material in the box.

In the equations of (5) above, the fact that the parameters given also depend on frequency has been ignored. These equations thus give only a rough quantatative idea of the behavior of the air in the box. At low frequencies, the element $C_{a3}$ will tend to predominate. This is easily seen physically as the diaphragms may be considered to be connected with each other mechanically through a "spring" which consists of the air in the box. If one pushes in on the diaphragm of one driver with the hand, the other will be moved out. Since the air moves slowly when this is done, its mass and resistance may be neglected, and it may be assumed to behave as a pure compliance.

Since the element $C_{a3}$ is the predominant element operating between the driver diaphragms at low frequencies, $M_{a3}$ and its series element, $r_{a3}$, may safely be neglected at low bass frequencies. Mechanical losses in the air (due to viscosity and friction) are negligible if the air moves slowly.

If the element $C_{a3}$ exists, there must be some corresponding change in the values of elements $C_{a1}$ and $C_{a2}$ since all the compliances within the box must originate from some interaction of the driver diaphragms upon the air inside the box. The changes in elements $C_{a1}$ and $C_{a2}$ will become clear if the two extreme phase differences in the diaphragm motions of drivers LS1 and LS2 are examined.

Acoustic elements $C_{a1}$ and $C_{a2}$ will increase in magnitude as the relative phase motions of the diaphragms of LS1 and LS2 become greater. They are minimum (FIG. 7*a*) when the relative diaphragm phase is zero, and infinite (i.e., zero reactance) for a relative phase of 180 (FIG. 7*c*). For a phase difference of zero, elements $C_{a1}$ and $C_{a2}$ will merge into $C_{box}$ as in FIGS. 5*c* and 7*a*. When the phase difference is 180° the only compliance operating in the box is $C_{a3}$. Thus, to a first approximation, $$C_{a1}=C_{a2}=\frac{C_{box}}{2}/(1-\sin(\theta/2)) \tag{6}$$

where $\theta$ is the phase difference in diaphragm motions, and both diaphragms are assumed to have the same effective area.

Acoustic components $M_{a1}$ and $M_{a2}$ (FIG. 4*b*) can be taken to be effectively constant at low frequencies to a first approximation, and can be assumed to be equal to the mass loading on the rear of the diaphragm given by equation (4).

We now have the information needed in order to calculate the new resonant frequency of a loudspeaker system using the present invention. The simplest embodiment, FIG. 8*a*, yields a net phase difference of:

$$\theta=\arctan(X_L/R)=\arctan(1.3/8)\Big/\begin{matrix}=9.1^\circ\\ \approx 40\text{ Hz}\end{matrix}$$

where $X_L=2\pi fL$, f being the frequency, as calculated above, L the inductance of inductor 44, and R the combined resistance of the inductance L and the voice-coil of LS2.

$$C_{a1} + C_{a2} = \frac{C_{box}}{1 - \sin(9.1/2)} = 6.38 \times 10^{-5} \text{ meters/newton.}$$

The new system resonant frequency is then $$f_O = \frac{1}{2\pi\sqrt{(.194)(6.38 \times 10^{-5})} \times \sqrt{1.4}} = 38.2 \text{ Hz.} \quad (7)$$

Thus the embodiment of the invention shown in FIG. 8*a* lowers the system resonance by about 1.6 Hz. Repeating the calculations for the embodiment of FIG. 8*b* also gives a lower system resonance, this time of about 38.0 Hz.

The actual resonant frequencies, as measured on operative loudspeaker systems constructed as described, are given as follows, where these frequencies are taken at the point where the phase angle of the input impedance to the system is zero:

(1) drivers in parallel: 38 Hz, (2) embodiment of FIG. 8*a*: 37 Hz, (3) embodiment of FIG. 8*b*: 34 Hz.

Thus the actual resonant frequencies are lower than those predicted by equation 7 using the values for elements $C_{a1}$ and $C_{a2}$ derived from equation 6. The actual resonant frequencies are lower than those predicted by equation 7 because the effect of element $C_{a3}$ upon the values of elements $C_{a1}$ and $C_{a2}$ has not been taken into account. The net effect of element $C_{a3}$ at low frequencies is to increase the compliances $C_{a1}$ and $c_{a2}$ to values higher than those given by equation 6. Thus, any prediction of the effect of the present invention derived by the use of equations 6 and 7 is likely to be conservative.

(4) Establishment of Increased Low-Bass Acoustic Output with the Invention

It has been shown that the invention lowers the effective resonant frequency of a speaker system in the bass acoustic range, but this fact alone will not insure greater bass output. It must also be shown that the vector sum of the two bass drvier outputs, at frequencies within the octave centered at the aforementioned resonant frequency, using the invention is greater than the total output of a system using the same two bass drivers connected electrically in parallel, or as connected using the "Nestorovic" system.

Figure 9:
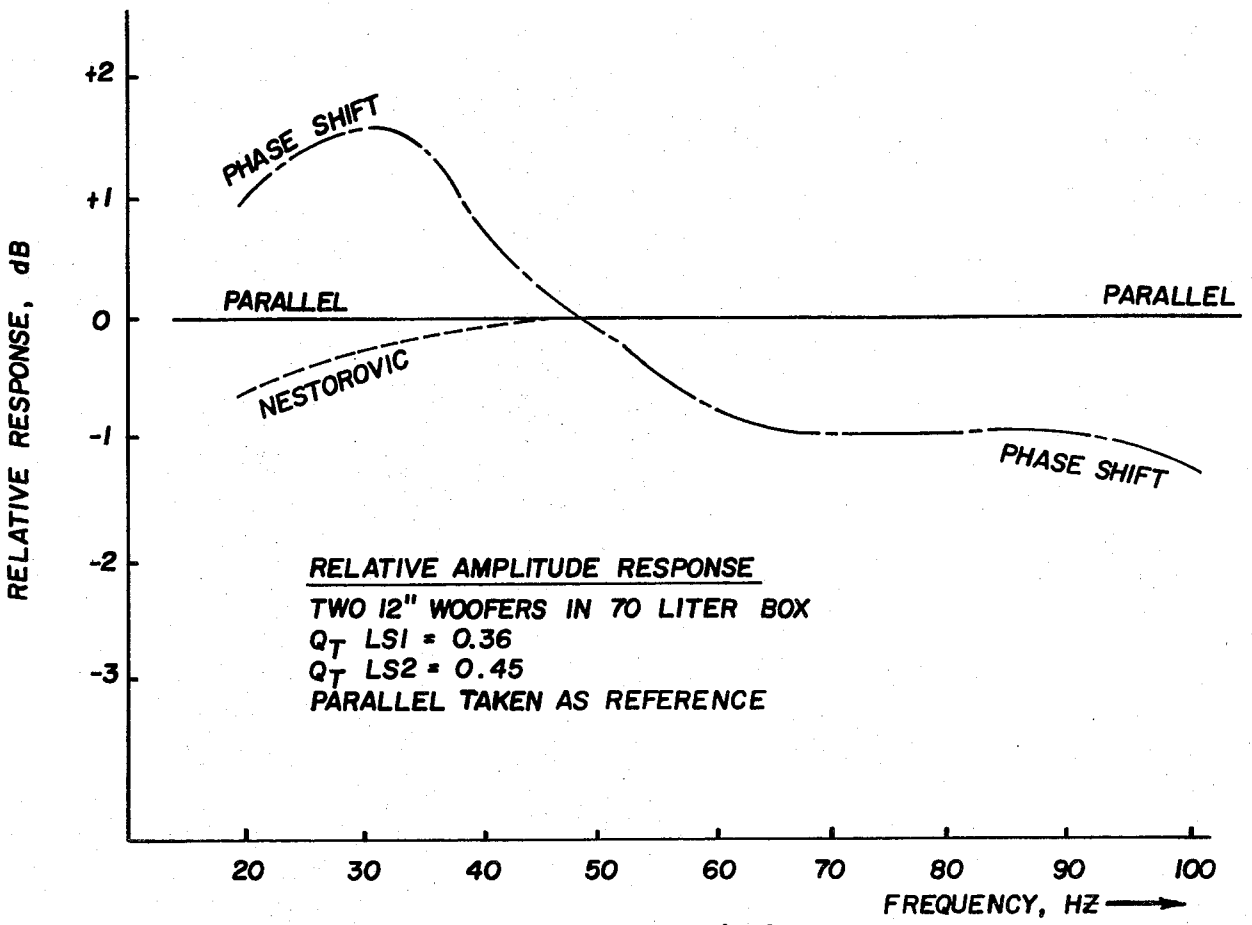
FIG. 9*a* shows graphically the relative sound output amplitude response vs. frequency for the phase shift embodiment of FIG. 8*a* of the present invention, using two 12" woofers in a 70 liter box as compared to such response in an identical box for the Nestorovic system, and additionally, a system involving connection of the woofers in parallel.
FIG. 9*b* shows graphically the sound output amplitude response vs. frequency for the phase shift embodiment of FIG. 8*a* using two 8" woofers in a 24 liter box as compared to such response in an identical box for the Nestorovic and parallel systems.
Figure 9B:
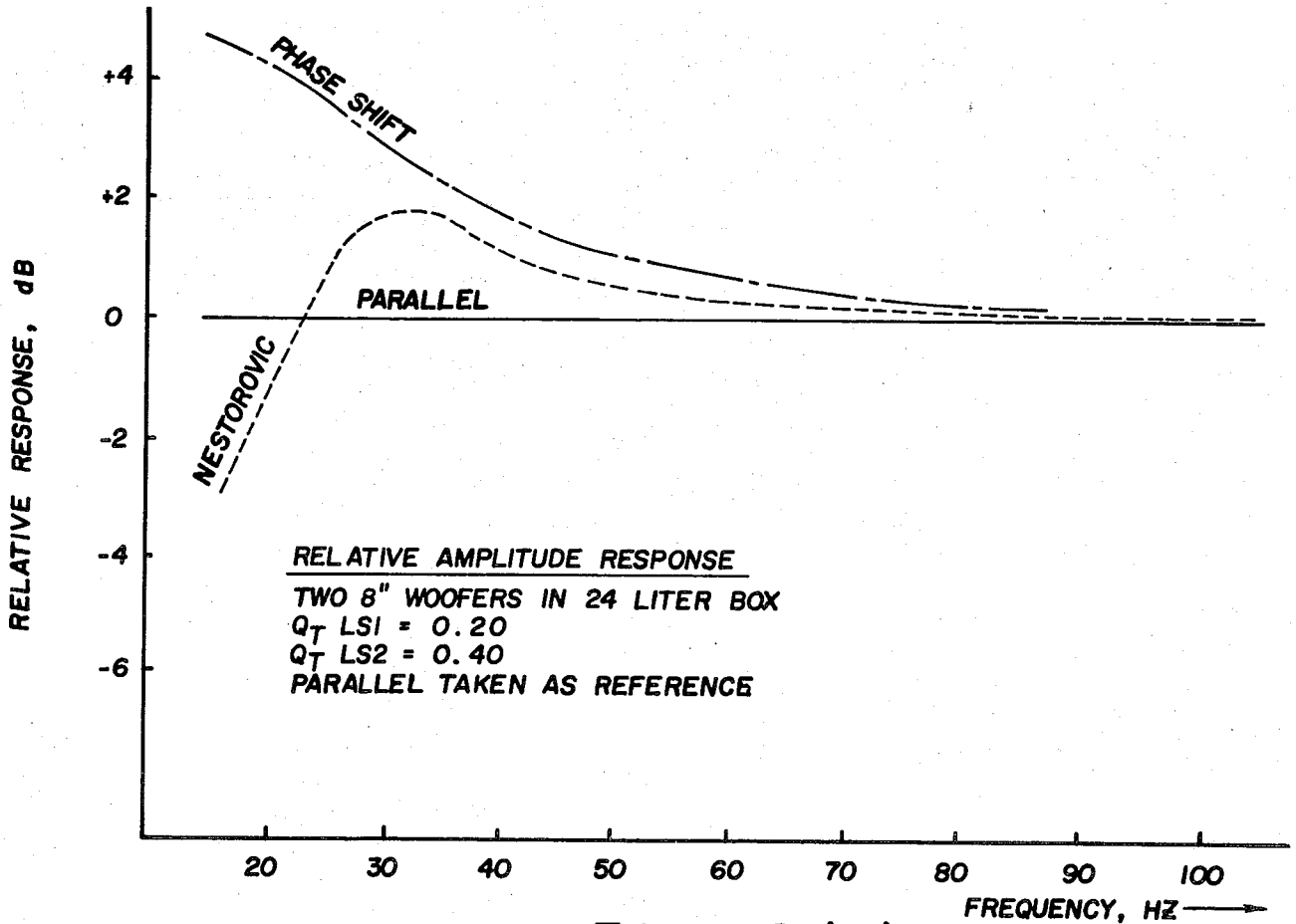

This is difficult to do mathematically, as it involves a direct general solution of the system differential equations (in Laplace transform form) for the model of FIGS. 3, 4*a* and 4*b*. Fortunately, it is very easy to simply build an operative embodiment of the invention and test it. FIGS. 9*a* and 9*b* display the relative frequency response, for a constant voltage input, of the various speaker systems of the kinds that have been discussed herein. It is noted that the phase shift system of the present invention has the highest low bass output of all the systems tested, even improving on the earlier "Nestorovic" system. FIG. 9*a* shows the relative frequency response vs. frequency for the parallel, Nestorovic and phase shift systems with two 12" woofers in a 70 liter box. FIG. 9*b* shows the relative response vs. frequency for the three systems with two 8" woofers in a 24 liter box.

The reduced output at the higher bass frequencies obtained with the present invention, as seen in FIGS. 9*a* and 9*b* is not a hinderance, but rather, an advantage. Thus, consider a multi-driver speaker system using two woofers or bass drivers driven electrically in parallel plus a single mdirange driver driven separately at midrange frequencies through its respective crossover filter circuit. Here, there will be three drivers radiating energy simultaneously at the woofer-midrange crossover frequency. This will cause the lower midrange frequencies (typically in the region of the male singing and speaking voice) to "beam" out at the listener. The effect upon the sound is to give a "heavy" character to the sound. Male voices tend to sound as if they are emanating from inside a barrel.

The embodiments of the invention illustrated in FIGS. 8*a* and 8*b* tend to cause a 90° phase difference between the two woofer diaphragms near the woofer-midrange crossover frequency. This has the effect of reducing the effective number of drivers radiating at the crossover from three (parallel connected woofers) to two (invention with differential phase of woofers 90° at crossover). If the present invention is employed in a typical "satellite" subwoofer system, it is advantageous to use an embodiment as is illustrated in FIG. 8*c*, which will force the two woofer diaphragms to operate 180° out of phase just above the woofer-midrange crossover frequency. This will prevent acoustic wave interference between the subwoofers and the upper frequency system, while reducing the number of drivers radiating at crossover from three to one.

Often it is advantageous, but not absolutely necessary, to use dissimilar drivers for woofers or bass drivers LS1 and LS2 to further enhance the smooth transition between upper bass and lower midrange frequencies. This is achieved by making the diaphragm mass of LS2 at least double that for LS1. This will cause the upper bass response of LS2 to fall much more rapidly than that for LS1, adding to the action of the phase shift network in reducing acoustic wave interference between the upper bass and lower midrange frequencies.

Particular embodiments of the invention which would benefit by having dissimilar drivers for LS1 and LS2, as mentioned above, would include (1) small bookshelf speaker systems in which the crossover frequency is on the order of 400 to 1000 Hz, and (2) satellite "subwoofer" systems in boxes separate from the "main" speaker system, wherein it is advantageous to cause the upper bass response of the subwoofer system to drop as rapidly as possible in order to prevent mutual interference with the main speaker system in the lower midrange and upper bass frequencies.

A speader system, where both LS1 and LS2 are mounted physically closely to the midrange driver in the same cabinet or box and having a woofer-midrange crossover frequency relatively low, for example, 175 Hz can use an embodiment of the present invention in which LS1 and LS2 are substantially identical.

Conclusion, With General Discussion of Characteristics of the Invention

Figure 10:
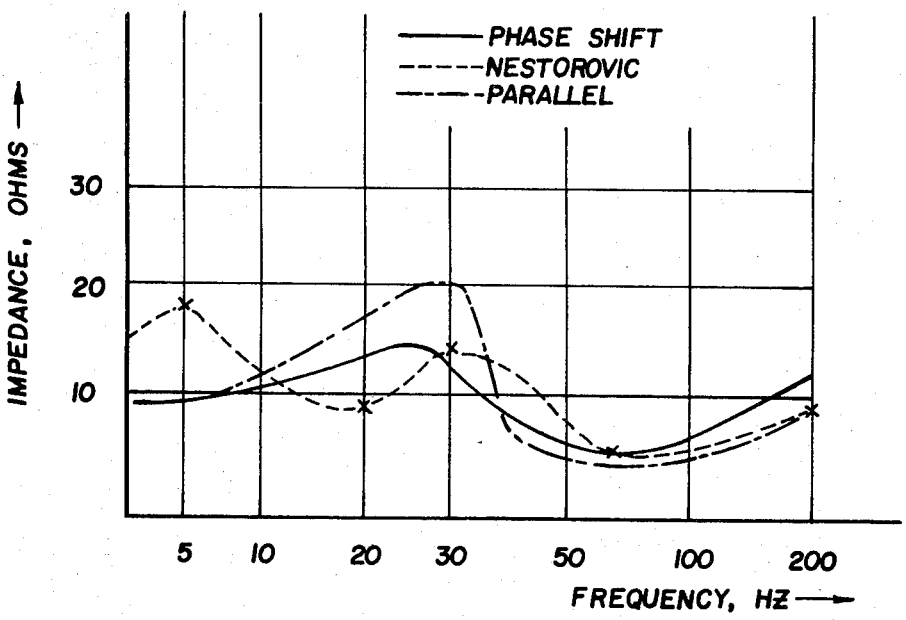
FIG. 10 shows graphically the input impedances for the speaker systems of FIG. 9*a*, all systems being in a closed box with openings only for the woofers.

Thus we see the two advantages of the invention (1) greater low bass sound output, and (2) elimination of excessive sound energy at upper bass frequencies. A still further advantage of the invention over the parallel connection of woofers or bass drivers LS1 and LS2 (shared with the inventor's earlier "Nestorovic" system) is that the input impedance of the speaker system is made more smooth in the entire bass region. FIG. 10 gives the input impedance for the same three low-bass speaker systems whose response appears in FIG. 9*a*.

Upon observation of FIG. 10 it is evident that the phase shift system of the present invention gives the smoothest impedance curve. Note that the "peaks" tend to be flattened and the "valleys" are filled. This is a desirable situation as it presents a more uniform load to the amplifier driving the speakers.

Consideration of the impedance curves of FIG. 10 necessitates a brief discussion of the system efficiency. System efficiency is defined as the ratio of the total acoustic energy radiated per unit time (acoustic power) divided by the total electrical input power; it can be expressed mathematically as: (Ref. 3, above-mentioned, P. 63)

$$n_o = K_n f_o^3 V_b$$

System is radiating into "free space" or a solid angle of $2\pi$ steradians.

Where $n_o$ is efficiency in per cent, $K_n$ is a physical constant adjusted for the type of system, i.e., closed-box. $f_o$ is the lower frequency point where acoustic pressure response is down 3 dB. (Half-power point). $V_b$ is the volume of the box.

Those skilled in the art will recognize that the drivers and the associated circuitry do not appear in the above equation. Given a specified lower cutoff frequency and box size for a closed-box speaker system, the efficiency is fixed and cannot be improved.

Examination of the impedance curves of FIG. 10 disclose that the phase-shift system has somewhat lower impedance below system resonance than the parallel connection, and both lower and higher impedance, depending on frequency, than the Nestorovic system. If input impedance is taken as a first-order approximation to efficiency, one can observe that the phase-shift system has no special advantage over prior art as to efficiency below system resonance.

Above system resonance, however, the phase-shift system exhibits the highest input impedance of the three systems. This is a desirable situation, since low-bass loudspeaker systems generally possess a minimum in input impedance above, not below, system resonance. Any means whereby this aforementioned mininum in input impedance can be increased relative to the input impedance below system resonance, and hence smooth out the total impedance characteristic, would be desirable.

Thus, while the phase-shift system may not be more efficient than prior art, it does possess the smoothest input impedance characteristic. Most importantly, the phase-shift system possesses the highest input impedance (FIG. 10) at the usual point of minimum impedance above system resonance, i.e., about 75 Hz in the particular case illustrated in FIG. 10.

When driven by a modern power amplifier, which always approximates a voltage source, those skilled in the art will understand that the phase-shift system will present a more uniform load to the amplifier than prior art. Along with this desirable impedance characteristic, the phase-shift system has been shown hereinbefore to possess improved low-bass acoustic output over prior art, and a lesser and controlled amount of upper bass acoustic output than prior art, both characteristics being desirable as set forth hereinbefore.

Figure 11A:
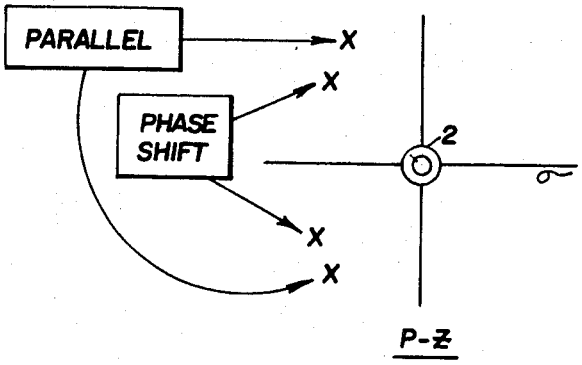
FIG. 11*a* is a pole-zero diagram showing the dominant p-z for the phase-shift and parallel loudspeaker systems.
Figure 11B:
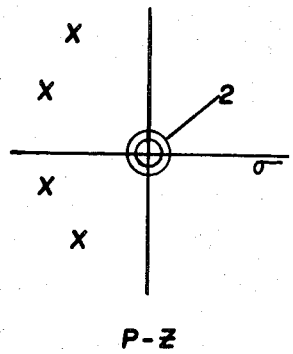
FIG. 11*b* is a pole-zero diagram showing the dominant p-z for the Nestorovic system.

Another fundamental difference between this invention and the inventor's earlier Nestorovic system should be evident from the impedance curves of FIG. 10. Specifically, the parallel and phase shift impedance curves have but a single peak in the low-bass region. This is characteristic of a transfer function having a single pair of dominant complex-conjugate poles in its transfer function as is illustrated in FIG. 11 (see also FIG. 1*d*). The Nestorovic system, on the other hand, shows two impedance peaks in the low bass region (see FIG. 10). This is characteristic of a transfer function having two pairs of dominant complex conjugate poles in its transfer function. The dominant p-z of the parallel and phase-shift systems are given in FIG. 11*a*, those for the Nestorovic systems being given in FIG. 11*b*.

Thus, there has been provided according to the present invention an improved method of and means for improving audio loudspeaker systems that provide enhanced fidelity of reproduction in the bass acoustic range and which overcome the problems of the prior art acoustic suspension and bass-reflex loudspeaker systems. This is accomplished by a phase shift method that allows the use of relatively large woofer, or bass driver diaphragms in relatively small cabinets or boxes. The usual driven single bass driver of the prior art audio loudspeaker systems is replaced by a pair of bass drivers having a total diaphragm area that is substantially equal to that of the usual single bass driver. A pair of conductors connects one of the two bass drivers directers to an electrical drive signal or energy source representing sound to be reproduced, while the other bass driver is connected to the electrical drive signal through a phase-shift network. Both bass drivers are housed and acoustically coupled in a closed cabinet or box common to both of them, the box having openings such that the drivers when mounted in the box have the front surfaces of their diaphragms open to the exterior of the box and the rear surfaces of their diaphragms facing the interior of the box. The component values of the phase shift network are such that at subsonic frequencies the electrical drive signals to the two bass drivers are in phase whereby the bass drivers may be considered to operate substantially in parallel. As the frequency of the electrical drive signal is increased, however, the electrical drive signals exhibit a phase difference to the two bass drivers, the phase difference increasing correspondingly with increase in frequency. This phase shift is sufficiently large even at low bass frequencies near and at system resonance, as explained hereinbefore, to effectively unload the box from the bass drivers thereby causing the total system to have enhanced low bass sound output. At higher bass frequencies, that is, near and at the woofer-midrange crossover frequency, the aforementioned phase shift is larger, which causes a reduction in acoustic output from the woofers, and a corresponding reduction in acoustic wave interference with the midrange driver, as explained hereinbefore.

As those skilled in the art will recognize, the present invention is not limited to the use of only two bass drivers in the same cabinet or box. Some multiple of bass drivers, i.e., 3, 4, 5, . . . , may be used, part of the total diaphragm area receiving its drive signal directly from the energy source and the remainder of the diaphragm area being connected to the energy source through the electrical phase-shift network. It is contemplated, also that any number of bass drivers greater than two may be used provided at least one electrical phase shift network is utilized and is connected so that at least one of the bass drivers, receives its drive signal from the energy source through the aforementioned phase shift network, with the system parameters so adjusted as to maximize the low bass sound output, and also to minimize acoustic wave interference with the midrange driver, or drivers, at the woofer-midrange crossover frequency.

Finally, it should be stated that the present invention finds best application in loudspeaker systems being "overdamped" woofers, with the woofer damping being defined as the factor "$Q_t$" familiar to those skilled in the art, and defined as, for example, on page 70 of reference 3. Almost all modern woofers are overdamped, with values of $Q_t$ of 0.18 to 0.45 being most common. Loudspeaker systems having "underdamped" woofers—no longer common—utilize woofers with values of $Q_t$ considerably greater than the critical value of 0.5, with values as high as 3.0. Woofers having high values of $Q_t$ have been used in the past in such devices as "juke boxes" and console radios, in order to develop a "boomy" and pronounced "one-note" bass sound, a type of response which is no longer acceptable in high-fidelity applications.

While the present invention has been explained by detailed decription of specific embodiments of it, it is to be understood that various changes and/or substitutions may be made in any of them within the scope of the appended claims which are intended to cover equivalents of the described specific embodiments.

I claim:

1. A method of enhancing the fidelity of response of audio loudspeaker systems in the bass acoustic range, which audio loudspeaker systems includes the usual bass loudspeaker system driver complement consisting of a single bass driver or woofer operating to reproduce sounds in the bass acoustic range, comprising the steps of replacing the usual single bass driver by a plurality of bass drivers having a total diaphragm area substantially equal to that of the usual single bass driver, housing and acoustically coupling the plurality of bass drivers in a cabinet common to them with their diaphragm front surfaces open to the exterior of the cabinet and their diaphragm rear surfaces facing the interior of the cabinet, and energizing the plurality of bass drivers from an electrical drive signal that is representative of the sound to be reproduced, the energization of at least one of the plurality of bass drivers being directly from the electrical drive signal and the energization of the remainder of the plurality of bass drivers being by the drive signal after passing said drive signal through an electrical phase shift network, thereby dividing the plurality of bass drivers into two sets, one set consisting of at least one driver receiving its energization directly from the electrical drive signal, the other set consisting of the remainder of the plurality of bass drivers receiving its energization from the electrical drive signal as modified by the phase shift network the parameters of which phase shift network are selected such that the electrical drive signals to the aforementioned sets in the plurality of bass drivers become in phase at very low frequencies so that effectively both sets in the plurality of bass drivers are then connected for operation substantially in parallel with the electrical drive signals to the aforementioned sets in the plurality of bass drivers becoming increasingly out of phase as the frequency is increased in the bass acoustic range.

2. A method as specified in claim 1 wherein the response of said plurality of bass drivers to the electrical drive signal cuts off at an upper frequency limit, said upper frequency limit being the woofer-midrange crossover frequency, and in which the parameters of the electrical phase shift network are such that the phase difference in the electrical drive signals to the two sets of bass drivers is nearly zero at very low frequencies and reaches approximately 90° at said upper frequency limit of the plurality of bass drivers.

3. A method as specified in claim 2 wherein the response of said plurality of bass drivers to the electrical drive signal cuts off at an upper frequency limit, said upper frequency limit being the woofer-midrange crossover frequency, and in which the parameters of the electrical phase shift network are such that the phase difference in the electrical drive signals to the two sets of bass drivers is nearly zero at very low frequencies and reaches approximately 180° at the upper frequency limit of said plurality of bass drivers.

4. A method as specified in claim 1 wherein the phase shift network is comprised of components the respective function and value of which relative to one another are so selected that at low bass frequencies within the octave centered at the system resonant frequency of the electrical drive signal to the loudspeaker system, the total sound output of the plurality of bass drivers is enhanced.

5. A method as specified in claim 1 wherein the audio loudspeaker systems may include the usual midrange driver having a lower frequency limit of response to the electrical drive signal, said lower frequency limit being the woofer-midrange crossover frequency, and wherein the electrical phase shift network is comprised of components the respective function and value of which relative to one another are so selected that as the frequency of the electrical drive signal to the loudspeaker system is increased to near the woofer-midrange crossover frequency the total sound output of the bass drivers is reduced whereby, when used with a midrange driver, the plurality of bass drivers cause minimum acoustic wave interference with the midrange driver at the woofer-midrange crossover frequency.

6. A method as specified in claim 1 wherein the plurality of bass drivers comprise only two bass drivers.

7. A method as specified in claim 6 wherein the electrical drive signal to the bass loudspeaker system is derived from a source having a pair of terminals one of which is positive with respect to the other, and wherein said phase shift network comprises an inductor that is connected between the positive terminal of the source and the positive terminal of that one of said plurality of bass drivers which receives said electrical drive signal modified by said phase shift network.

8. A method as specified in claim 7 wherein said electrical phase shift network further includes a capacitor connected in shunt with the voice coil of that one of said plurality of bass drivers which receives said electrical drive signal modified by said phase shift network.

9. A method as specified in claim 6 wherein said phase shift network comprises an "all pass delay network".

10. A method as specified in claim 1 wherein the number of bass drivers comprise an integral multiple of two, and wherein one-half of the total diaphragm area of the bass drivers receives its driving actuation directly from the electrical drive signal and one-half of the total diaphragm area of the bass drivers receives its driving actuation from the electrical drive signal after passing said signal through said phase shift network.

11. An audio loudspeaker system operating in the bass acoustic range, in which system the usual single bass driver or woofer is replaced by a plurality of bass drivers or woofers each having a diaphragm, the total diaphragm area of such plurality of bass drivers being substantially equal to the diaphragm area of the replaced usual single bass driver, and including a cabinet, said plurality of bass drivers being housed and acoustically coupled in said cabinet, the cabinet having openings such that the plurality of bass drivers when mounted therein have the front surfaces of their diaphragms open to the exterior and the rear surfaces of their diaphragms facing to the interior of the cabinet, an electrical phase shift network, and connecting means for connecting the plurality of bass drivers to an electrical drive signal that is representative of the sound to be reproduced, said connecting means including a direct connection between at least one of said plurality of bass drivers and the electrical drive signal and including another connection between the remainder of said plurality of bass drivers and the electrical drive signal, said phase shift network being connected in said another connection of said connecting means whereby the electrical drive signal to the remainder of said plurality of bass drivers passes through said phase shift network, the plurality of bass drivers thereby being divided into two sets, one set consisting of at least said one of said plurality of bass drivers being energized directly by the electrical drive signal and the other set consisting of the remainder of said plurality of bass drivers being energized by the electrical drive signal as modified by said phase shift network, the parameters of said phase shift network being such that the electrical drive signals to the two sets in the plurality of bass drivers become substantially in phase at very low bass acoustic frequencies whereby both sets of bass drivers in said plurality of bass drivers are then operatively connected substantially in parallel and the electrical drive signals to the two sets in the plurality of bass drivers become increasingly out of phase as the frequency is increased in the bass acoustic range.

12. An audio loudspeaker system as specified in claim 11 wherein the plurality of bass drivers comprises only two bass drivers.

13. An audio loudspeaker system as specified in claim 12 wherein the bass driver that is connected to the electrical drive signal by said another connection of said connecting means has a cone mass that is substantially higher than that of the other bass driver.

14. An audio loudspeaker system as specified in claim 12 wherein the self-resonance in free air of the bass driver that is connected to the electrical drive signal by said another connection is substantially lower than that of the other bass driver.

15. An audio loudspeaker system as specified in claim 12 in which both bass drivers are housed in a sealed cabinet whereby the system is adapted to operate similarly to the acoustic suspension principle.

16. An audio loudspeaker system as specified in claim 12 in which the electrical phase shift network makes use of mutually-coupled coils in order to enhance the performance of the electrical phase shift network with regard to the phase shift characteristic of said network, and to enhance the upper frequency response rolloff of the electrical drive signal to the bass driver that is energized by the electrical drive signal as modified by said phase shift network.

17. An audio loudspeaker system as specified in claim 12 in which the response of said plurality of bass drivers to the electrical drive signal cuts off at an upper frequency limit, said upper frequency limit being the woofer-midrange crossover frequency, and in which the parameters of the electrical phase shift network are such that the phase difference in the electrical drive signals to said sets of bass drivers is nearly zero at very low frequencies and approximates 90° at the upper frequency limit of the bass drivers.

18. An audio loudspeaker system as specified in claim 12 in which the response of said plurality of bass drivers to the electrical drive signal cuts off at an upper frequency limit, said upper frequency limit being the woofer-midrange crossover frequency, and in which the parameters of the electrical phase shift network are such that the phase difference in the electrical drive signals to said sets of bass drivers is zero at very low frequencies and approximates 180° at the upper frequency limit of the bass drivers.

19. An audio loudspeaker system as specified in claim 11 which may include the usual midrange driver having a lower frequency limit of response to the electrical drive signal, said lower frequency limit being the woofer-midrange crossover frequency, and wherein the electrical phase shift network is comprised of components the respective function and value of which relative to one another are so selected that as the frequency of the electrical drive signal to said loudspeaker system is increased to near the woofer-midrange crossover frequency the total sound output of the bass drivers is reduced whereby, when used with a mid-range driver, the bass drivers cause minimum acoustic wave interference with the midrange driver at the woofer-midrange crossover frequency.

20. An audio loudspeaker system as specified in claim 12 wherein the electrical drive signal is derived from a source having a pair of terminals one of which is positive with respect to the other, and wherein said phase shift network comprises an inductor that is connected between the positive terminal of the source and said another one of said plurality of bass drivers.

21. An audio loudspeaker system as specified in claim 20 wherein the electrical phase shift network further includes a capacitor that is connected in shunt with the voice coil of that one of said plurality of bass drivers which is energized by the electrical drive signal as modified by said phase shift network.

22. An audio loudspeaker system as specified in claim 12 wherein the electrical phase shift network comprises an "all pass delay network".

23. An audio loudspeaker system as specified in claim 11 wherein the number of bass drivers comprise an integral multiple of two and wherein one-half of the total diaphragm area of the bass drivers receives its driving actuation directly from the electrical drive signal and one-half of the total diaphragm area of the bass drivers receives its driving actuation from the electrical drive signal after said signal is passed through said phase shift network.

24. An audio loudspeaker system as specified in claim 11 wherein the number of bass drivers is greater than two and wherein the parameters of the electrical phase shift network are so adjusted as to maximize the output of the total plurality of bass drivers in the bass frequency region within the octave centered at the system resonant frequency.

25. An audio loudspeaker system as specified in claim 11 wherein the number of bass drivers comprises an odd number and wherein at least one of the drivers receives its driving actuation directly from the electrical drive signal and the remainder receive the driving actuation from the electrical drive signal after being passed through said phase shift network.

26. An audio loudspeaker system as specified in claim 11 wherein the electrical components of the phase-shift network; inductors, mutually-coupled inductors, and capacitors; function not only to provide an electrical phase difference in the drive signals to the two sets of bass drivers, but also to provide low-pass filtering as part of, or all of, the bass driver crossover low-pass filter system.

27. A method as specified in claim 1 wherein the woofers, or bass drivers, comprising the plurality of drivers within the loudspeaker system all possess values of $Q_t$ less than the critical value of 0.5.

28. An audio loudspeaker system as specified in claim 11 wherein the woofers, or bass drivers, comprising the plurality of drivers within said loudspeaker system, all possess values of $Q_t$ less than the critical value of 0.5.

* * * * *